US007117791B2

(12) United States Patent
Matsuura

(10) Patent No.: US 7,117,791 B2
(45) Date of Patent: Oct. 10, 2006

(54) INK FOUNTAIN APPARATUS FOR PRINTING PRESS

(75) Inventor: Fuminori Matsuura, Chiba (JP)

(73) Assignee: Komori Corporation, Tokyo (JP)

( * ) Notice: Subject to any disclaimer, the term of this patent is extended or adjusted under 35 U.S.C. 154(b) by 189 days.

(21) Appl. No.: 10/888,310

(22) Filed: Jul. 8, 2004

(65) Prior Publication Data

US 2005/0011380 A1 Jan. 20, 2005

(30) Foreign Application Priority Data

Jul. 17, 2003 (JP) ..... 2003-198276

(51) Int. Cl.
*B41F 31/00* (2006.01)

(52) U.S. Cl. ..... 101/350.5; 101/350.1; 101/364

(58) Field of Classification Search ..... 101/363, 101/364, 365, 366, 367, 423, 425, 350.1, 101/350.5

See application file for complete search history.

(56) References Cited

U.S. PATENT DOCUMENTS

| | | | | |
|---|---|---|---|---|
| 1,953,105 | A * | 4/1934 | Flinker | 101/210 |
| 2,920,558 | A * | 1/1960 | Hewlett | 101/364 |
| 5,603,263 | A * | 2/1997 | Dufour et al. | 101/423 |
| 5,809,887 | A | 9/1998 | Blackwell et al. | |
| 6,772,684 | B1 * | 8/2004 | Kanayama | 101/350.1 |
| 6,782,819 | B1 * | 8/2004 | Oumiya et al. | 101/363 |

FOREIGN PATENT DOCUMENTS

| | | | |
|---|---|---|---|
| GB | 646066 | | 11/1950 |
| GB | 924401 | | 4/1963 |
| GB | 2079220 | | 1/1982 |
| JP | 02-15352 | U | 1/1990 |
| JP | 08020154 | A * | 1/1996 |

* cited by examiner

*Primary Examiner*—Ren Yan
(74) *Attorney, Agent, or Firm*—Blakely Sokoloff Taylor & Zafman

(57) ABSTRACT

An ink fountain apparatus for a printing press includes an ink fountain roller, bottom plate, ink fountain, and scraping member. The ink fountain roller is supported rotatably. The bottom plate is arranged at such a position that its distal end portion is close to the ink fountain roller. The ink fountain has a pair of ink dams. The ink dams are arranged in a direction substantially perpendicular to the bottom plate, and oppose each other in an axial direction of the ink fountain roller. Each of the ink dams includes an elastic member and first and second urging members. The elastic member abuts against an outer surface of the ink fountain roller and the bottom plate. The first and second urging members urge the elastic member toward the outer surface of the ink fountain roller and the bottom plate. The scraping member is arranged more downstream of an opposed position, where the ink fountain roller opposes a downstream roller, in a rotational direction of the ink fountain roller, and serves to return ink attaching to the ink fountain roller into the ink fountain.

17 Claims, 5 Drawing Sheets

INK FOUNTAIN APPARATUS FOR PRINTING PRESS

BACKGROUND OF THE INVENTION

The present invention relates to an ink fountain apparatus which stores ink to be supplied to a plate surface in a printing press.

As shown in Japanese Utility Model Laid-Open No. 2-15352, a conventional ink fountain apparatus for a printing press has an ink fountain including a rotatably supported ink fountain roller, a bottom plate arranged at a position close to the ink fountain roller, and a pair of ink dams arranged in a direction perpendicular to the bottom plate and opposing each other in the widthwise direction of the bottom plate. The ink dams are moved and adjusted in the vertical direction and back-and-forth direction, and are fixed after their distal end faces are aligned with the outer surface of the ink fountain roller.

In the conventional ink fountain apparatus for the printing press, as the total length in the axial direction of the ink fountain roller is larger than the total length in the axial direction of an ink ducting roller, noncontact portions which do not come into contact with the ink ducting roller are present on the two end portions of the ink fountain roller. Ink on the noncontact portions is not transferred to the ink ducting roller but remains on the ink fountain roller as excessive ink. When the excessive ink drops on a printing product, a printing trouble occurs.

As the front end of each ink dam must form an arc having the same radius of curvature as that of the outer surface of the ink fountain roller, machining of the ink dam requires high accuracy. A gap, although small, tends to be formed between the front end of the ink dam and the outer surface of the ink fountain roller. As the ink fountain roller rotates over a long period of time, the front end of the ink dam wears to gradually form a gap between the front end of the ink dam and the outer surface of the ink fountain roller. Consequently, ink leaks through the gap, also causing a printing trouble.

SUMMARY OF THE INVENTION

It is an object of the present invention to provide an ink fountain apparatus for a printing press, in which a printing trouble caused by excessive ink or ink leakage is prevented.

In order to achieve the above object, according to the present invention, there is provided an ink fountain apparatus for a printing press, comprising a rotatably supported ink fountain roller, a bottom plate arranged at such a position that a distal end portion thereof is close to the ink fountain roller, an ink fountain having a pair of ink dams arranged in a direction substantially perpendicular to the bottom plate and opposing each other in an axial direction of the ink fountain roller, each of the ink dams including an elastic member which abuts against an outer surface of the ink fountain roller and the bottom plate, and urging means for urging the elastic member toward the outer surface of the ink fountain roller and the bottom plate, and a scraping member arranged more downstream of an opposed position, where the ink fountain roller opposes a downstream roller, in a rotational direction of the ink fountain roller and serving to return ink attaching to the ink fountain roller into the ink fountain.

DESCRIPTION OF THE PREFERRED EMBODIMENT

The present invention will be described in detail with reference to the accompanying drawings.

Figure 1:
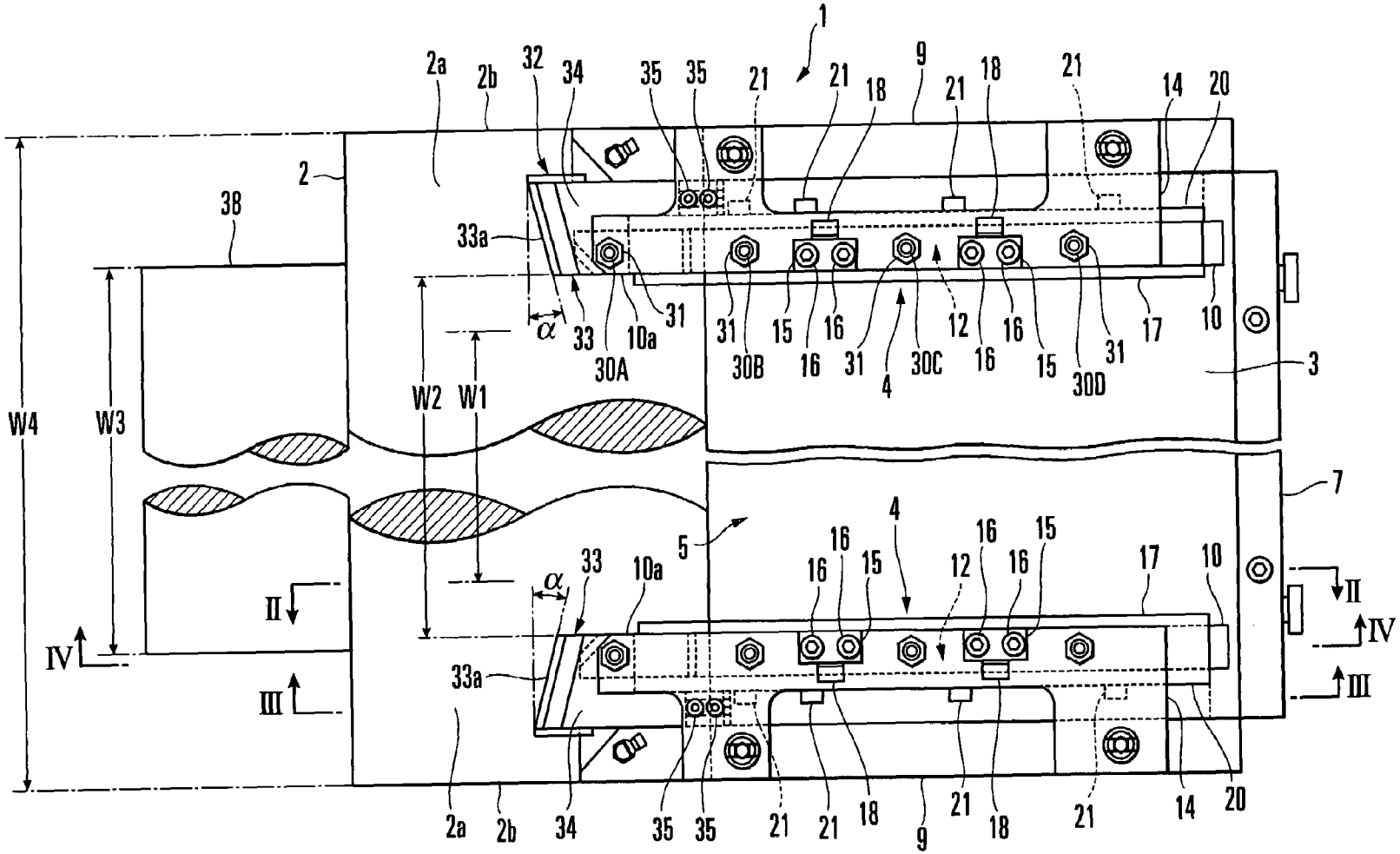
FIG. 1 is a plan view of an ink fountain apparatus for a printing press according to an embodiment of the present invention.
Figure 2:
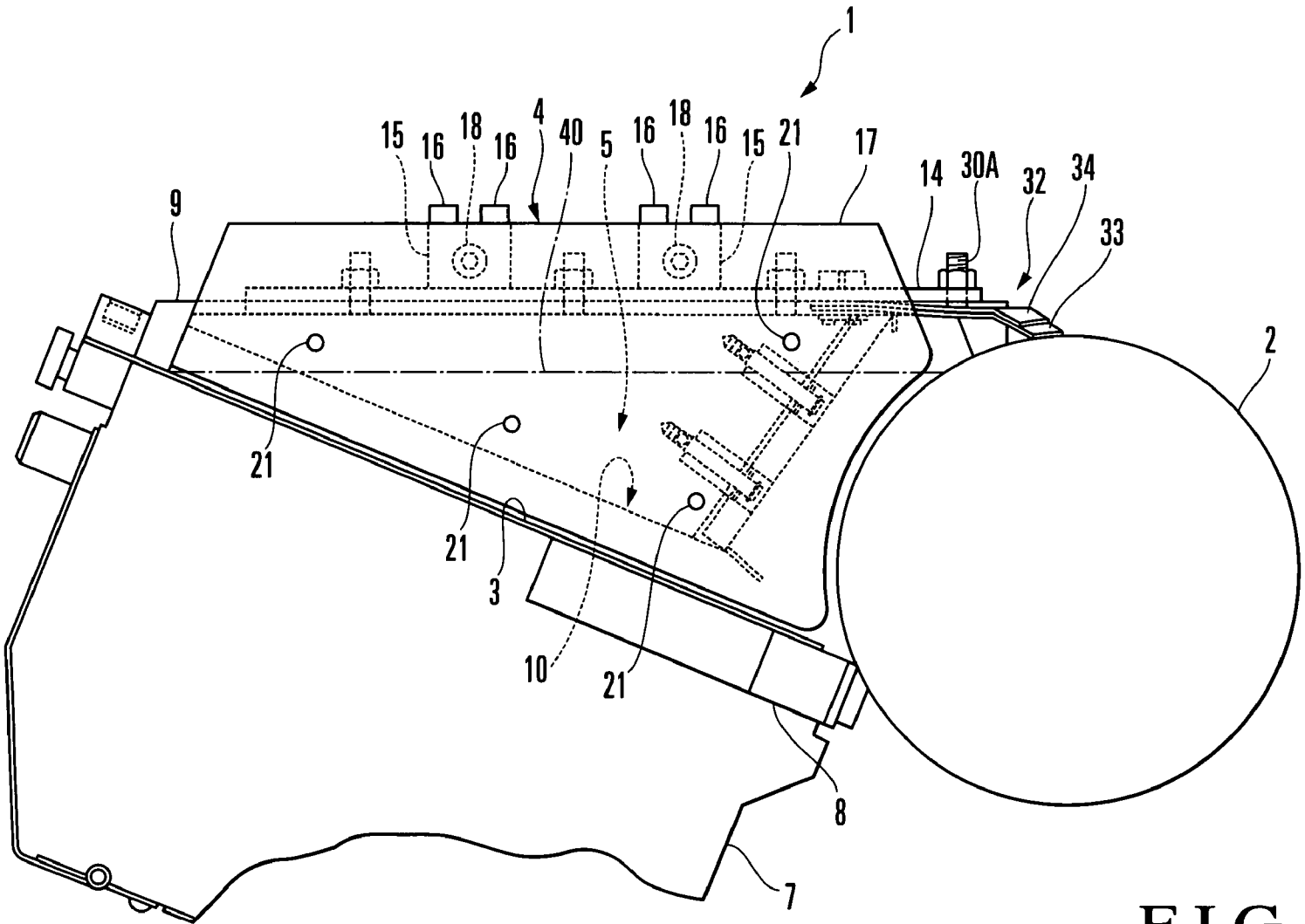
FIG. 2 is a sectional view taken along the line of arrows II—II of FIG. 1.

FIGS. 1 to 5 show an ink fountain apparatus for a printing press according to an embodiment of the present invention. As shown in FIG. 1, an ink fountain apparatus 1 has an ink fountain 5 including an ink fountain roller 2 rotatably, axially supported by a pair of frames (not shown) opposing each other through a predetermined gap, a bottom plate 3 one end of which is close to the outer surface of the ink fountain roller 2, and a pair of ink dams 4 arranged substantially perpendicularly to the bottom plate 3 and opposing each other in the axial direction of the ink fountain roller 2.

Figure 3:
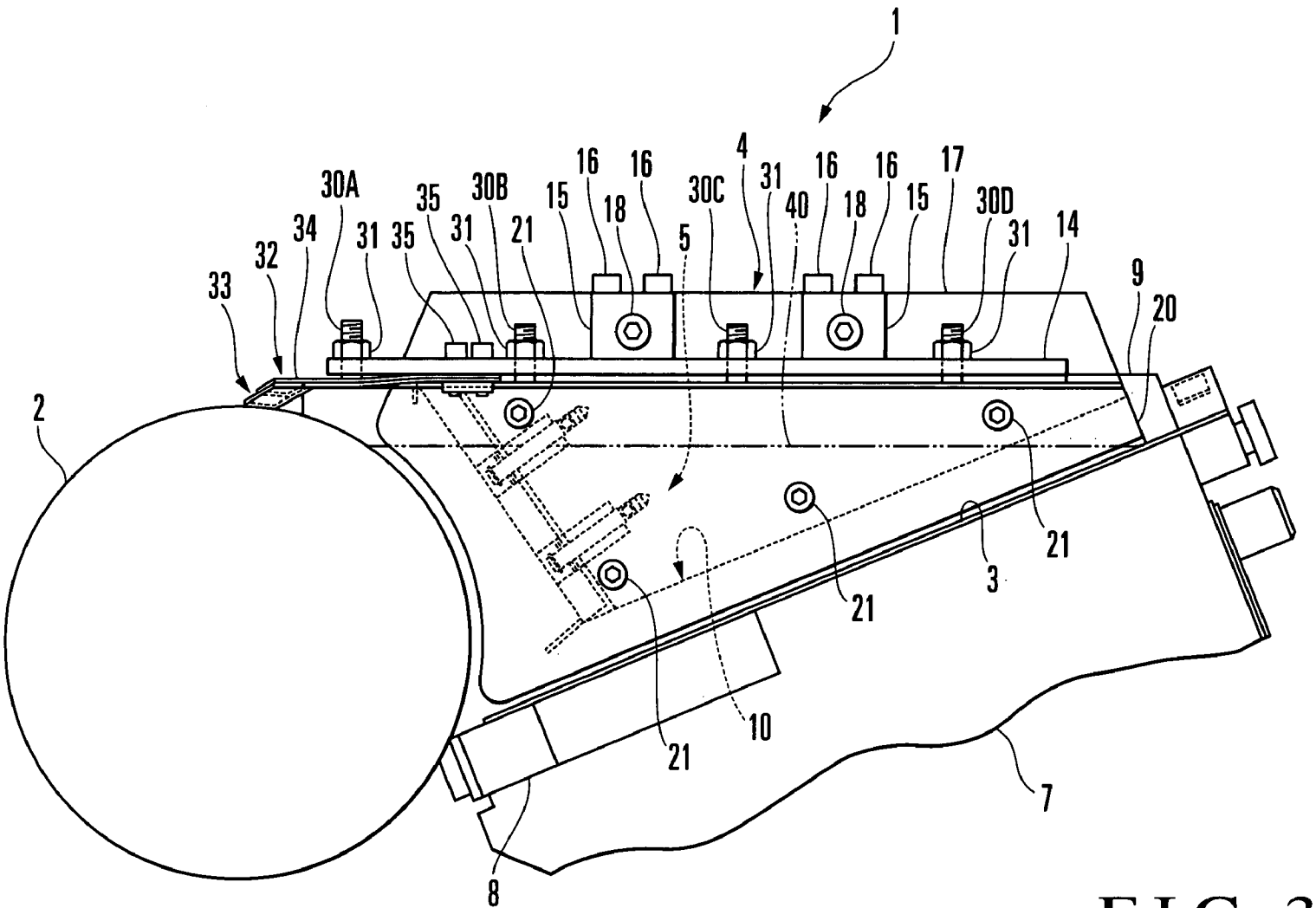
FIG. 3 is a sectional view taken along the line of arrows III—III of FIG. 1.

As shown in FIG. 3, an ink fountain main body 7, the distal end side of which is pivotally supported by the pair of frames through pivot shafts, moves between an operative position where it forms the ink fountain 5 together with the ink fountain roller 2, and a retreat position where it has retreated downward from the operative position and the bottom plate 3 becomes substantially horizontal.

On the ink fountain main body 7, a large number of ink fountain keys 8 supported at the distal end portion of the bottom plate 3 are arranged parallel to each other in the axial direction of the ink fountain roller 2. The ink fountain keys 8 include a pair of stationary keys arranged on the two end sides in the axial direction of the ink fountain roller 2 and fixed to the ink fountain main body 7, and a large number of movable keys arranged between the pair of stationary keys and adjustable in directions to come close to and separate from the outer surface of the ink fountain roller 2. The ink fountain keys 8 are covered, except for their distal end portions, by the bottom plate 3 formed of one thin steel plate, and are brought into tight contact with the bottom plate 3 by the attracting force of magnets (not shown) buried in them.

As shown in FIG. 1, the pair of support plates 9 are fixed to the pair of stationary keys such that they project upright perpendicularly to the bottom plate 3 and oppose each other. The front end faces of the support plates 9 form arcuate surfaces to come into tight contact with the outer surfaces on the two end portions of the ink fountain roller 2.

Figure 4:
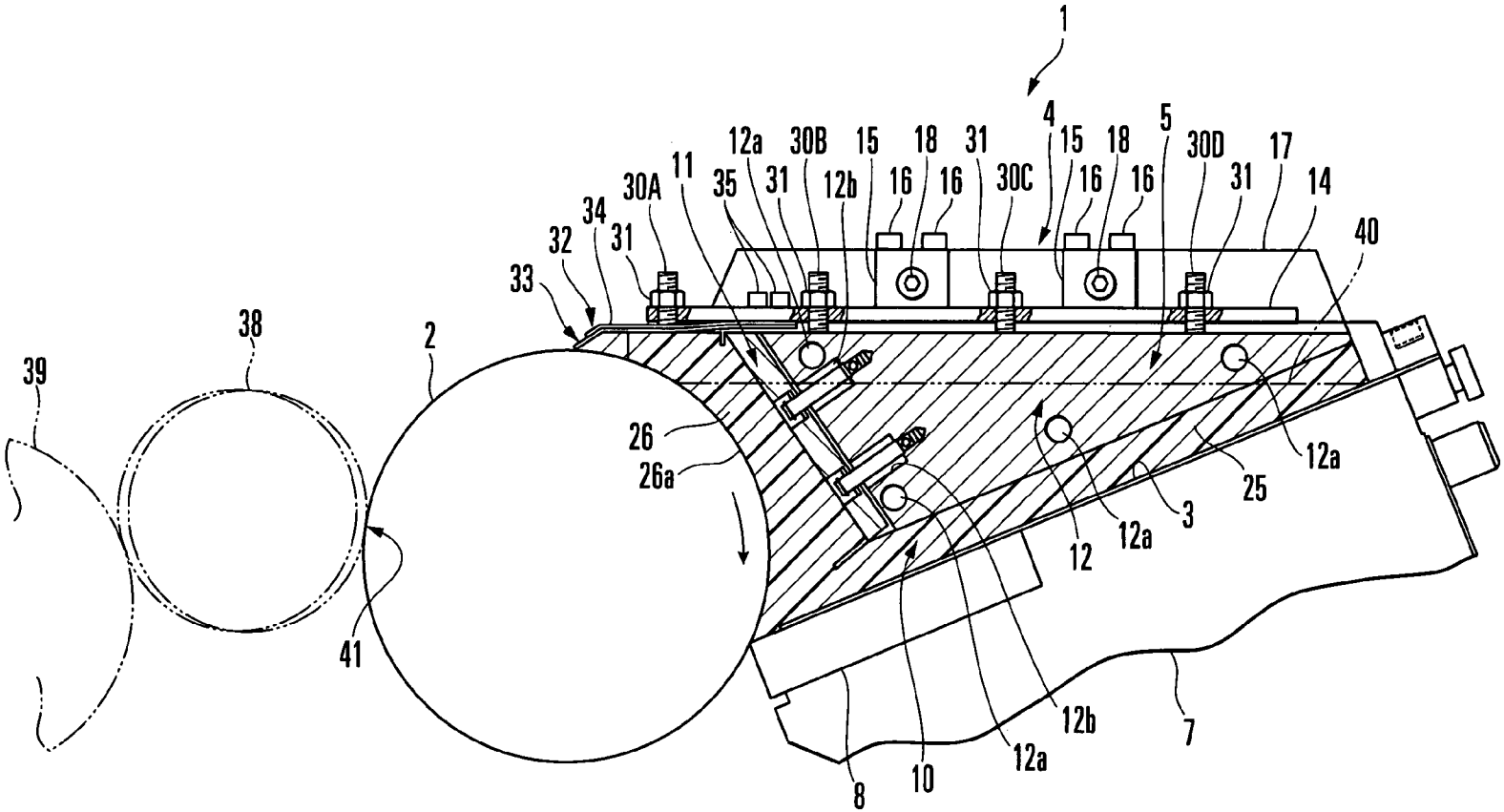
FIG. 4 is a sectional view taken along the line of arrows IV—IV of FIG. 1.

As shown in FIG. 4, each ink dam 4 includes an elastic member 10 which has an L-shaped section and abuts against the outer surface of the ink fountain roller 2 and the bottom plate 3, a first urging member 11 which urges the elastic member 10 toward the outer surface of the ink fountain roller 2, and a second urging member 12 which urges the elastic member 10 toward the surface of the bottom plate 3. The elastic member 10 is made of a chemical-resistant elastic material such as polyvinyl chloride (PVC).

The second urging member 12 is formed of a flat metal material to have a triangular shape when seen from the side. The second urging member 12 has four through holes 12*a* extending in the direction of thickness (axial direction of the ink fountain roller 2). The diameter of each through hole 12*a* is larger than the diameter of a corresponding one of bolts 21 (to be described later). The second urging member 12 has two recesses 12*b* in its side close to the ink fountain roller 2. Guide pins 13 serving as urging means stand upright from the bottom portions of the recesses 12*b*, respectively. The distal ends of the guide pins 13 project from the recesses 12*b*.

As shown in FIG. 1, two stationary blocks 15 are fixed with bolts 16 to the upper surfaces of support plates 14 horizontally attached to the upper ends of the pair of support plates 9, respectively. A pair of first side plates 17 are fixed to the stationary blocks 15 of the pair of support plate 14 with bolts 18, such that they oppose each other and are perpendicular to the bottom plate 3.

Second side plates 20 are attached to the respective first side plates 17, each by screwing four bolts 21 extending through the through holes 12*a* into the screw holes of the corresponding first side plate 17, such that the second urging members 12 are clamped between the second and first side plates 20 and 17, respectively. At this time, each second urging member 12 is supported between the corresponding first and second side plates 17 and 20 to be movable in the vertical direction and back-and-forth direction for a distance corresponding to the clearance between each bolt 21 and the corresponding through hole 12*a*.

Figure 5:
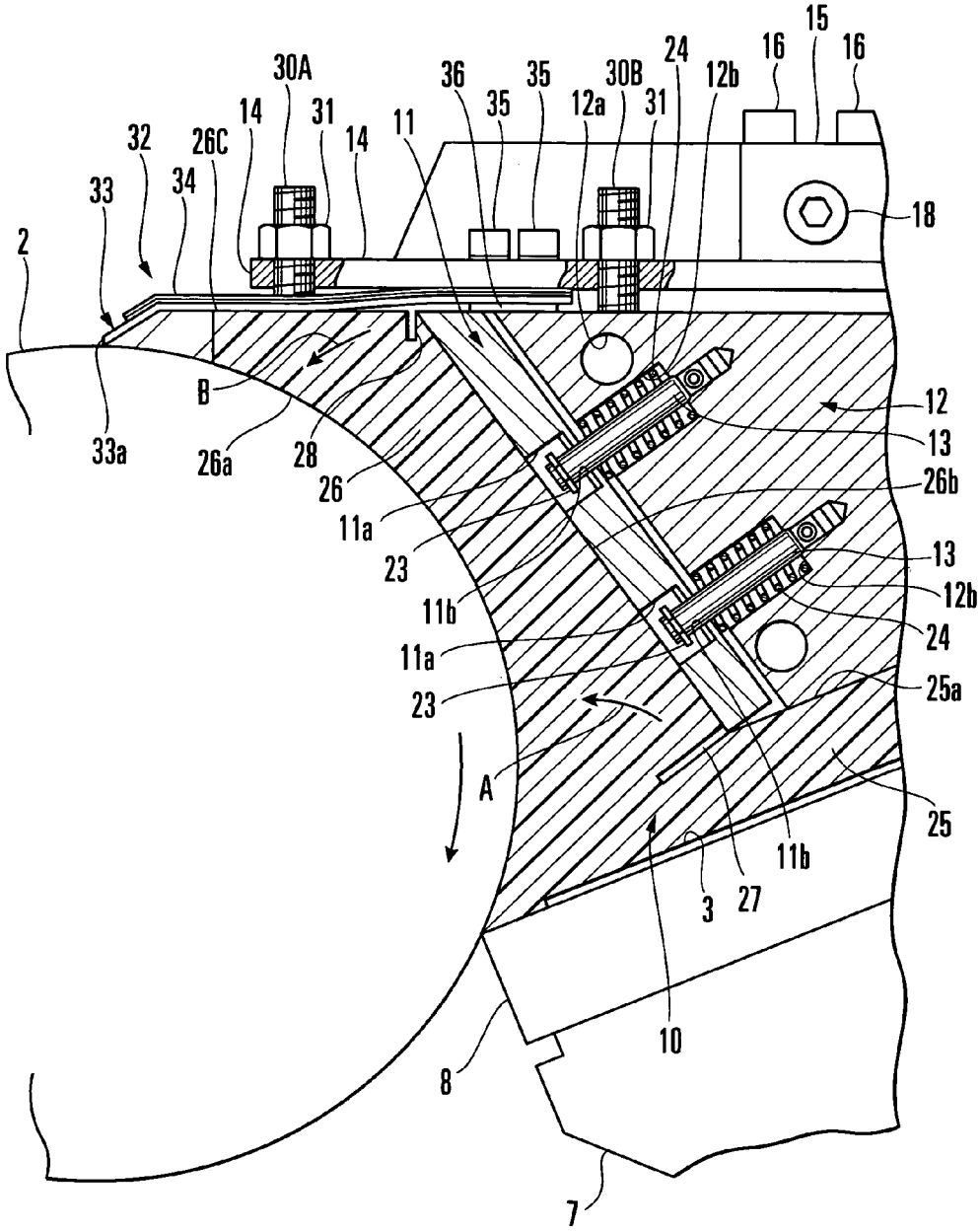
FIG. 5 is an enlarged view of the main part of FIG. 4.

As shown in FIG. 5, the thin and elongated substantially rectangular parallelepiped first urging member 11 made of a metal material has a pair of recesses 11*a* to correspond to the guide pins 13. Guide holes 11*b* each having a diameter slightly larger than that of the corresponding guide pin 13 are formed in the bottom portions of the recesses 11*a*. The distal end portions of the guide pins 13 are inserted in the guide holes 11*b* of the first urging member 11, and E-rings 23 are fitted on the distal end portions of the guide pins 13, to movably support the first urging member 11 with the second urging member 12 through the guide pins 13. Compression coil springs 24 serving as urging means are elastically mounted on the guide pins 13, respectively, between the first urging member 11 and the bottom portions of the recesses 12*b* of the second urging member 12. The first urging member 11 is biased by the spring force of the compression coil springs 24 substantially toward the center of the ink fountain roller 2.

As shown in FIG. 4, the substantially L-shaped elastic member 10 includes a base portion 25 which abuts against the bottom plate 3, and an upright portion 26 which abuts against the outer surface of the ink fountain roller 2. An outer side surface 26*a* of the upright portion 26 has an arcuate surface with the same radius of curvature as that of the outer surface of the ink fountain roller 2. As shown in FIG. 5, the elastic member 10 has a first groove 27 at the intersection of an upper surface 25*a* of the base portion 25 and an inner side surface 26*b* of the upright portion 26, and a second groove 28 at the intersection of an upper surface 26*c* and an inner side surface 26*b* of the upright portion 26.

Both the first and second grooves 27 and 28 are formed to extend in the direction of the thickness of the elastic member 10 entirely. The first groove 27 is directed in a direction substantially perpendicular to the inner side surface 26*b* of the upright portion 26. The second groove 28 is directed in a direction perpendicular to the upper surface 26*c*. Namely, the first and second grooves 27 and 28 are formed in different directions. The elastic member 10 thus formed is fitted between the corresponding first and second side plates 17 and 20. Accordingly, as shown in FIG. 4, the base portion 25 of the elastic member 10 is clamped between the bottom plate 3 and second urging member 12, and the upright portion 26 of the elastic member 10 is clamed between the outer surface of the ink fountain roller 2 and the first urging member 11.

As shown in FIG. 4, set screws 30A to 30D arranged in a line on the ink fountain apparatus 1 serve as urging means for threadably engaging with screw holes in the support plate 14. Of the set screws, the set screw 30A serves as an adjusting member which moves a scraping member 32 (to be described later) in directions to come close to and separate from the outer surface of the ink fountain roller 2, that is, which adjusts the urging force toward the outer surface of the ink fountain roller 2. At this time, the set screw 30A urges the elastic member 10 through the scraping member 32. Simultaneously, the set screw 30A also has a function of urging the upright portion 26 of the elastic member 10 against the outer surface of the ink fountain roller 2. The remaining set screws 30B to 30D have a function of urging the base portion 25 of the elastic members 10 against the bottom plate 3 through the first urging member 11. Nuts 31 fix the set screws 30A to 30D to the support plate 14.

As shown in FIG. 5, the scraping member 32 includes an abutting member 33 formed of a thin plate having a V-shaped section, and a leaf spring 34 which is overlaid on the abutting member 33 and has a sectional shape substantially the same as that of the abutting member 33. The abutting member 33 is made of a chemical-resistant, wear-resistant material, e.g., fluoroplastic. The proximal end portions of the abutting member 33 and leaf spring 34 are overlaid on each other and are clamped between a clamping member 36 and the support plate 14 by bolts 35 threadably engaging with the clamping member 36.

The scraping member 32, the proximal end portion of which is clamped in this manner, is biased by the spring force of the leaf spring 34, so that an abutting portion 33*a* at the distal end of the abutting member 33 comes into pressure contact with the outer surface of the ink fountain roller 2. As shown in FIG. 1, the abutting portion 33*a* of the abutting member 33 is inclined inwardly toward the bottom plate 3 of the ink fountain 5 by an angle $\alpha$ with reference to the axial direction of the ink fountain roller 2. More specifically, the abutting portion 33*a* of the abutting member 33 forms an acute angle $\alpha$ downstream in the rotational direction of the ink fountain roller 2. The distal end of the set screw 30A threadably engaging with the screw hole of the support plate 14 abuts against the central portion of the leaf spring 34 of the scraping member 32. Thus, when the forward/backward moving amount of the set screw 30A is adjusted, the urging force of the abutting portion 33*a* of the abutting member 33 generated by the leaf spring 34 against the outer surface of the ink fountain roller 2 can be adjusted.

As shown in FIG. 4, an ink ductor roller 38 reciprocally moves between the ink fountain roller 2 and a distribution roller 39 to alternately come into contact with them.

As shown in FIG. 1, a distance W2 between the elastic members 10 of the pair of ink dams 4 is set larger than a width (length in a direction perpendicular to the sheet convey direction) W1 of a maximum-size sheet. A total length W3 in the axial direction of the ink ductor roller 38 is set slightly larger than the distance W2 between the elastic members 10 of the pair of ink dams 4. A total length W4 in the axial direction of the ink fountain roller 2 is set larger than the total length W3 in the axial direction of the ink ductor roller 38.

Accordingly, noncontact portions 2*a* which do not come into contact with the ink ductor roller 38 are present on the two end portions of the ink fountain roller 2. When seen from the top, the abutting portion 33*a* of the abutting member 33 which forms the scraping member 32 is disposed between a side surface 10*a* on the ink fountain 5 side of the elastic member 10 and a vicinity of an end face 2*b* of the ink fountain roller 2, that is, across a region corresponding to the noncontact portion 2*a* and that region of the ink fountain roller 2 which comes into contact with the ink ductor roller 38. As shown in FIG. 4, the abutting portion 33*a* of the abutting member 33 is arranged more downstream of an opposed position 41, where the ink fountain roller 2 opposes the ink ductor roller 38, in the rotational direction of the ink fountain roller 2.

The ink supply operation of the ink fountain apparatus for the printing press having the above arrangement will be described.

Referring to FIG. 4, of the ink fountain keys 8, a large number of movable keys are moved forward/backward in advance, to set the distance between the outer surface of the ink fountain roller 2 and the movable keys in accordance with the image. Ink 40 is stored in the ink fountain 5. In this state, when printing is started, as the ink fountain roller 2 rotates clockwise, an amount of ink corresponding to the distance with respect to the movable keys of the ink fountain keys 8 transfers onto the outer surface of the ink fountain roller 2.

When the ink ductor roller 38 serving as the downstream roller comes into contact with the ink fountain roller 2 through the opposed position 41, the ink attaching to the outer surface of the ink fountain roller 2 transfers to the outer surface of the ink ductor roller 38. Subsequently, the ink ductor roller 38 comes into contact with the distribution roller 39, so that the ink transferred to the outer surface of the ink ductor roller 38 transfers to the outer surface of the distribution roller 39. The ink which has not been transferred from the ink fountain roller 2 to the ink ductor roller 38 through the opposed position 41 but is remaining on the outer surface of the ink fountain roller 2 is transported downstream in the rotational direction of the ink fountain roller 2 from the opposed position 41, while attaching to the outer surface of the ink fountain roller 2, and is returned into the ink fountain 5.

Of the ink attaching to the outer surface of the ink fountain roller 2, the ink which has attached to the noncontact portions 2*a* on the two end portions of the ink fountain roller 2 during rotation of the ink fountain roller 2 does not transfer to the ink ductor roller 38, because the noncontact portions 2*a* do not come into contact with the ink ductor roller 38 through the opposed position 41, and remains on the noncontact portions 2*a*. The ink remaining on the noncontact portions 2*a* is scraped from the outer surface of the ink fountain roller 2 by the scraping members 32 (the abutting portions 33*a* of the abutting members 33) which are disposed at positions to correspond to the noncontact portions 2*a* and provided more downstream of the opposed position 41 in the rotational direction of the ink fountain roller 2.

At this time, the scraped ink is returned into the ink fountain 5 by each abutting portion 33*a* which is inclined inwardly toward the bottom plate 3 of the ink fountain 5 by the angle $\alpha$ and extends on the side surface 10*a* of the ink fountain 5. Consequently, no excessive ink remains on the noncontact portions 2*a* to drop onto a printing product, so that a printing trouble can be prevented.

The abutting member 33 is made of the chemical-resistant fluoroplastic and will not be deformed by the ink. Thus, the abutting member 33 can scrape the ink semipermanently without changing the scraping member 32. The urging force of the abutting portion 33*a* against the outer surface of the ink fountain roller 2 can be adjusted through the leaf spring 34 by moving the set screw 30A forward/backward, and the excessive ink remaining on the noncontact portion 2*a* can be returned into the ink fountain 5 reliably.

The base portion 25 of the elastic member 10 which forms the ink dam 4 is urged by the second urging member 12 against the bottom plate 3 of the ink fountain 5, and deforms elastically to come into tight contact with the bottom plate 3. The upright portion 26 of the elastic member 10 is urged by the first urging member 11 against the outer surface of the ink fountain roller 2, and deforms elastically to come into tight contact with the outer surface of the ink fountain roller 2. Therefore, the ink 40 in the ink fountain 5 does not leak through the gap between the bottom plate 3 and the base portion 25 of the elastic member 10, and the gap between the upright portion 26 of the elastic member 10 and the outer surface of the ink fountain roller 2, and a printing trouble can accordingly be prevented.

The base portion 25 comes into tight contact with the bottom plate 3 by the elastic deformation of the elastic member 10 fitted between the first and second side plates 17 and 20, and the upright portion 26 comes into tight contact with the outer surface of the ink fountain roller 2. Thus, the operation of bringing the ink dam 4 into tight contact with the bottom plate 3 and the outer surface of the ink fountain roller 2 becomes unnecessary.

In particular, when the upright portion 26 is urged by the second urging member 12 through the first groove 27 formed in the upright portion 26 of the elastic member 10, the lower side of the upright portion 26 deforms elastically in the direction of an arrow A, so as to be uniformly urged against the outer surface of the ink fountain roller 2. Therefore, the tight contact between the lower side of the upright portion 26 and the outer surface of the ink fountain roller 2 improves. Similarly, when the upright portion 26 is urged by the set screw 30A through the second groove 28 formed in the upright portion 26 of the elastic member 10, the upper side of the upright portion 26 deforms elastically in the direction of an arrow B, so as to be uniformly urged against the outer surface of the ink fountain roller 2. Therefore, the tight contact between the upper side of the upright portion 26 and the outer surface of the ink fountain roller 2 improves. Consequently, no gap is formed between the upright portion 26 of the elastic members 10 and the outer surface of the ink fountain roller 2, and ink leakage through such a gap can be prevented more reliably.

Since the elastic members 10 are made of chemical-resistant PVC, their deformation caused by the ink can be prevented. As the PVC has wear resistance as well, wear of the elastic members 10 can be decreased, so that the elastic members 10 need not be changed over a long period of time. Even if the upright portions 26 of the elastic members 10 wear along with the long-term rotation of the ink fountain roller 2, because the upright portions 26 are urged against the outer surface of the ink fountain roller 2 by the spring force of the compression coil springs 24, any printing trouble that can be caused by the wear can be prevented reliably.

In this embodiment, the abutting members 33 are abutted against the outer surface of the ink fountain roller 2. Alternatively, the leaf springs 34 may be directly abutted against the outer surface of the ink fountain roller 2. The scraping members 32 are supported by the ink dams 4. Alternatively, the scraping members 32 may be supported by the frames of the printing press.

When each elastic member 10 is to be urged toward the bottom plate 3 and the outer surface of the ink fountain roller 2, it can be urged directly by the guide pins 13, compression coil springs 24, and set screws 30A to 30D serving as the urging means, without employing the first and second urging members 11 and 12.

As has been described above, according to the present invention, the operation of bringing the ink dams into tight contact with the bottom plate and the outer surface of the ink fountain roller becomes unnecessary. Since the outer surface of the ink fountain roller and the ink dams reliably come into tight contact with each other to prevent ink leakage, a printing trouble can be prevented. Also, the excessive ink on the two end portions of the ink ductor roller can be reliably returned into the ink fountain.

The excessive ink attaching to the ink fountain roller can be returned into the ink fountain more reliably. Due to the presence of the grooves formed in the elastic members, the alignment accuracy of the outer surface of the ink fountain roller and the elastic members improves. Thus, the machining accuracy of the elastic members need not be high, so that the machining cost can be decreased.

The tight contact between the scraping members and the outer surface of the ink fountain roller is improved by the spring properties of the scraping members that abut against the outer surface of the ink fountain roller. Thus, the excessive ink attaching to the ink fountain roller can be returned into the ink fountain more reliably.

Since the elastic members are made of wear-resistant, chemical-resistant polyvinyl chloride, wear of the elastic members can be prevented. The outer appearance and mechanical characteristics of the elastic members are not changed by the ink, and deformation of the elastic members is prevented. Thus, the tight contact between the outer surface of the ink fountain roller and the elastic members is maintained.

What is claimed is:

1. An ink fountain apparatus for a printing press, comprising:

a rotatably supported ink fountain roller;

a bottom plate arranged at such a position that a distal end portion thereof is close to said ink fountain roller;

an ink fountain having a pair of ink dams arranged in a direction substantially perpendicular to said bottom plate and opposing each other in an axial direction of said ink fountain roller; and a scraping member arranged downstream of an opposed position, where said ink fountain roller opposes a downstream roller, in a rotational direction of said ink fountain roller and serving to return ink attaching to said ink fountain roller into said ink fountain, said scraping member includes a thin plate-like abutting member which abuts against the outer surface of said ink fountain roller, and a leaf spring, a proximal end portion of which is overlaid on a proximal end portion of said thin plate-like abutting member to urge a distal end portion of said thin plate-like abutting member against the outer surface of said ink fountain roller.

2. An apparatus according to claim 1, wherein said scraping member has spring properties and is constantly biased in a direction to urge the outer surface of said ink fountain roller.

3. An apparatus according to claim 2, further comprising an adjusting member which adjusts an urging force of said scraping member against the outer surface of said ink fountain roller.

4. An apparatus according to claim 3, wherein said scraping member and adjusting member are sequentially arranged on an upper surface of an elastic member which abuts against an outer surface of said ink fountain roller and said bottom plate, and said adjusting member urges said elastic member through said scraping member.

5. An apparatus according to claim 1, wherein said scraping member is attached to an upper end face of each one of said ink dams to be inclined to a downstream side in a rotational direction of said ink fountain roller from an end portion side toward a central side of said ink fountain roller.

6. An apparatus according to claim 1, wherein said scraping member is made of chemical-resistant fluoroplastic.

7. An ink fountain apparatus for a printing press, comprising:

a rotatably supported ink fountain roller;

a bottom plate arranged at such a position that a distal end portion thereof is close to said ink fountain roller;

an ink fountain having a pair of ink dams arranged in a direction substantially perpendicular to said bottom plate and opposing each other in an axial direction of said ink fountain roller, each of said ink dams including an elastic member which abuts against an outer surface of said ink fountain roller and said bottom plate, and urging means for urging said elastic member toward the outer surface of said ink fountain roller and said bottom plate, wherein said elastic member has first and second grooves, said elastic member is deformed elastically by an urging force in a first direction to come into tight contact with the outer surface of said ink fountain roller through the first groove when urged by said urging means, and said elastic member is deformed elastically by an urging force in a second direction different from the first direction to come into tight contact with the outer surface of said ink fountain roller through the second groove when urged by said urging means.

8. An apparatus according to claim 7, wherein the first and second grooves are formed in different directions.

9. An apparatus according to claim 7, wherein said elastic member is made of a chemical-resistant, wear-resistant material.

10. An apparatus according to claim 9, wherein said elastic member is made of polyvinyl chloride.

11. An apparatus according to claim 7, wherein said elastic member is formed of a base portion which comes into contact with said bottom plate, and an upright portion an outer side surface of which comes into arcuate contact with the outer surface of said ink fountain roller, to form a substantial L-shape, and said first groove is formed at a position where an inner side surface of said base portion and an inner side surface of said upright portion intersect.

12. An ink fountain apparatus for a printing press, comprising:

a rotatably supported ink fountain roller;

a bottom plate arranged at such a position that a distal end portion thereof is close to said ink fountain roller;

an ink fountain having a pair of ink dams arranged in a direction substantially perpendicular to said bottom plate and opposing each other in an axial direction of said ink fountain roller; and a scraping member arranged downstream of an opposed position, where said ink fountain roller opposes a downstream roller, in a rotational direction of said ink fountain roller and serving to return ink attaching to said ink fountain roller into said ink fountain a total length in an axial direction of said ink fountain roller is set larger than a total length in an axial direction of said downstream roller, and said scraping member is arranged across a region of said ink fountain roller which does not come into contact with said downstream roller and a region of said ink fountain roller which comes into contact with said downstream roller.

13. An apparatus according to claim 12, wherein said scraping member has spring properties and is constantly biased in a direction to urge the outer surface of said ink fountain roller.

14. An apparatus according to claim 13, further comprising an adjusting member which adjusts an urging force of said scraping member against the outer surface of said ink fountain roller.

15. An apparatus according to claim 14, wherein said scraping member and adjusting member are sequentially arranged on an upper surface of an elastic member which abuts against an outer surface of said ink fountain roller and said bottom plate, and said adjusting member urges said elastic member through said scraping member.

16. An apparatus according to claim 12, wherein said scraping member is attached to an upper end face of each one of said ink dams to be inclined to a downstream side in a rotational direction of said ink fountain roller from an end portion side toward a central side of said ink fountain roller.

17. An apparatus according to claim 12, wherein said scraping member is made of chemical-resistant fluoroplastic.

* * * * *